US010589308B2

(12) United States Patent
Kieffer

(10) Patent No.: US 10,589,308 B2
(45) Date of Patent: Mar. 17, 2020

(54) FINGER REST FOR A LIQUID APPLICATOR

(71) Applicant: Wagner Spray Tech Corporation, Plymouth, MN (US)

(72) Inventor: Joseph W. Kieffer, Chanhassen, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 0 days.

(21) Appl. No.: 15/081,313

(22) Filed: Mar. 25, 2016

(65) Prior Publication Data

US 2016/0318057 A1 Nov. 3, 2016

Related U.S. Application Data

(60) Provisional application No. 62/155,232, filed on Apr. 30, 2015.

(51) Int. Cl.

| | |
|---|---|
| ***B05B 15/63*** | (2018.01) |
| *B05B 9/01* | (2006.01) |
| *B05B 15/62* | (2018.01) |
| *B05B 12/00* | (2018.01) |

(52) U.S. Cl.

CPC ..... *B05B 15/63* (2018.02); *B05B 9/01* (2013.01); *B05B 12/002* (2013.01); *B05B 15/62* (2018.02)

(58) Field of Classification Search

CPC ..... B05B 13/0636; B05B 9/01–0894; B05B 12/002; B05B 1/3026; B05B 15/00; B05B 15/62; B05B 15/65; B05B 15/63; B05B 15/60; B05B 7/02; B05B 12/0024; B05B 7/2478; B05B 15/16; B05B 1/18; B65H 2220/01; B65H 2220/02; B08B 3/026; B25G 1/00; B25G 1/10; B25G 1/102; Y10T 16/466; Y10T 16/476; Y10T 16/48

USPC ..... 239/73, 526, 375, 525, 530, 529, 531, 239/532

See application file for complete search history.

(56) References Cited

U.S. PATENT DOCUMENTS 3,137,880 A * 6/1964 Kubit ..... B05C 17/00 15/210.1
3,353,203 A * 11/1967 Ginter ..... A46B 11/00 15/145
5,370,314 A * 12/1994 Gebauer ..... B05B 12/002 239/526

(Continued)

FOREIGN PATENT DOCUMENTS

| | | | | |
|---|---|---|---|---|
| CN | 101687209 A | | 3/2010 | |
| EP | 1247586 A1 | | 10/2002 | |
| GB | 2364900 A | * | 2/2002 | ..... A46B 5/04 |
| JP | 4588237 B2 | | 11/2010 | |

OTHER PUBLICATIONS

International Search Report and Opinion for PCT/US2016/024718, dated Jul. 11, 2016, Filed Mar. 29, 2016. 11 pages.

(Continued)

*Primary Examiner* — Viet Le
*Assistant Examiner* — Juan C Barrera
(74) *Attorney, Agent, or Firm* — Christopher J. Volkmann; Kelly, Holt & Christenson, PLLC

(57) ABSTRACT

A finger rest for a liquid applicator is presented. The finger rest comprises a base. The finger rest also comprises an aperture configured to receive a handle of the liquid applicator. The base is configured to rotationally align with a head of the liquid applicator at a junction.

15 Claims, 8 Drawing Sheets

(56) References Cited

U.S. PATENT DOCUMENTS

| | | | | |
|---|---|---|---|---|
| 5,991,956 | A | 11/1999 | Chapman | |
| 7,347,136 | B2 * | 3/2008 | Bruggeman | F16J 10/04 29/888.06 |
| 8,720,801 | B2 * | 5/2014 | Kinoshita | B05B 7/1209 239/424.5 |
| 2003/0042333 | A1 | 3/2003 | Wiersma et al. | |
| 2006/0186232 | A1 | 8/2006 | Kassanits | |
| 2007/0080243 | A1 * | 4/2007 | Alexander | B05B 15/061 239/526 |
| 2008/0251610 | A1 * | 10/2008 | Franks | B05B 7/0416 239/433 |
| 2008/0296410 | A1 * | 12/2008 | Carey | B05B 9/01 239/526 |
| 2011/0127356 | A1 * | 6/2011 | Hsu | B05B 9/01 239/526 |
| 2014/0014741 | A1 | 1/2014 | Escoto, Jr. | |

OTHER PUBLICATIONS

International Preliminary Report on Patentability for International Patent Application No. PCT/US2016/024718, dated Nov. 9, 2017, 10 pages.

First Office Action for Chinese Patent Application No. 201680004341.3 dated Nov. 5, 2018, 17 pages.

First Examination Report for Australian Patent Application No. 2016255372 dated Mar. 29, 2018, 4 pages.

Extended European Search Report for European Application No. 16786897.5 dated Nov. 6, 2018, 11 pages.

Supplementary Partial European Search Report for European Patent Application No. 16 786 897.5 dated Jul. 19, 2018, 10 pages.

Second Examination Report for Australian Patent Application No. 2016255372 dated Jul. 2, 2018, 4 pages.

Second Office Action from Chinese Patent Application No. 201680004341.3 dated Jun. 19, 2019, 17 pages.

* cited by examiner

FINGER REST FOR A LIQUID APPLICATOR

CROSS-REFERENCE TO RELATED APPLICATIONS

The present application is based on and claims the benefit of U.S. Provisional Patent Application Ser. No. 62/155,232 filed Apr. 30, 2015, the contents of which are hereby incorporated by reference in its entirety.

BACKGROUND

A liquid dispensing system may be used by an operator in order to deliver a solution, for example, from a storage area to an application area and then applied to a surface. Liquid dispensing systems often include an applicator to apply the delivered solution to a surface. In using a paint applicator, for example, an operator may apply pressure to a trigger in order to actuate a pressurized flow of paint through the applicator. However, the position of the user's hand on the applicator, over a painting operation, may create tension, or irritation for the user during a paint application process.

SUMMARY

A finger rest for a liquid applicator is presented. The finger rest comprises a base. The finger rest also comprises an aperture configured to receive a handle of the liquid applicator. The base is configured to rotationally align with a head of the liquid applicator at a junction.

DETAILED DESCRIPTION OF ILLUSTRATIVE EMBODIMENTS

Aspects of the present disclosure relate to liquid applicators, more particularly to a finger rest configured to ensure comfortable use of a liquid applicator. While the present disclosure is not necessarily limited to such applications, various aspects of the disclosure may be appreciated through a discussion of various examples that use paint as an example liquid handled by a liquid applicator.

Liquid applicators may be useful for dispensing a variety of fluids, for example aqueous-based or oil-based solutions, varnishes, paint, texture, coatings or other appropriate fluid.

In one embodiment, a liquid applicator receives a liquid solution and at least partially aerosolizes the liquid such that it can be sprayed onto a surface as aerosolized droplets. While paint is discussed in detail as one example fluid, an applicator may be used to apply any fluid, for example a gas, a texture compound, or other liquid, as desired by a user.

A grip, support, or finger rest, for example, can be attached and unattached, as needed, to a paint applicator handle. In one embodiment, attaching and unattaching a grip comprises screwing and unscrewing the grip from the handle and/or the body of the paint applicator. In another embodiment, attaching or unattaching comprises another actuation mechanism, for example actuating one or more latches or clips, or another closure mechanism.

It is not uncommon, when a handle is reattached to a paint applicator, for example after a cleaning operation, for the handle to be unintentionally over-screwed or under-screwed. As a result, the finger rest may not be properly aligned with the head of the paint applicator during a subsequent paint operation. Such a misalignment may still allow the paint applicator to function, but cause irritation or discomfort to a user's hand. It is desired, then, for a finger rest for a paint applicator that can be removed and reattached to the head of the paint applicator, assist a user in properly gripping the paint applicator, while alleviating irritation and discomfort. In one embodiment, a finger rest may be configured such that it is easy for a user of an applicator to clearly see when the handle has been properly reattached to the paint applicator head, to ensure proper alignment and reduce the risk of experienced irritation, fatigue or discomfort during use.

Figure 1:
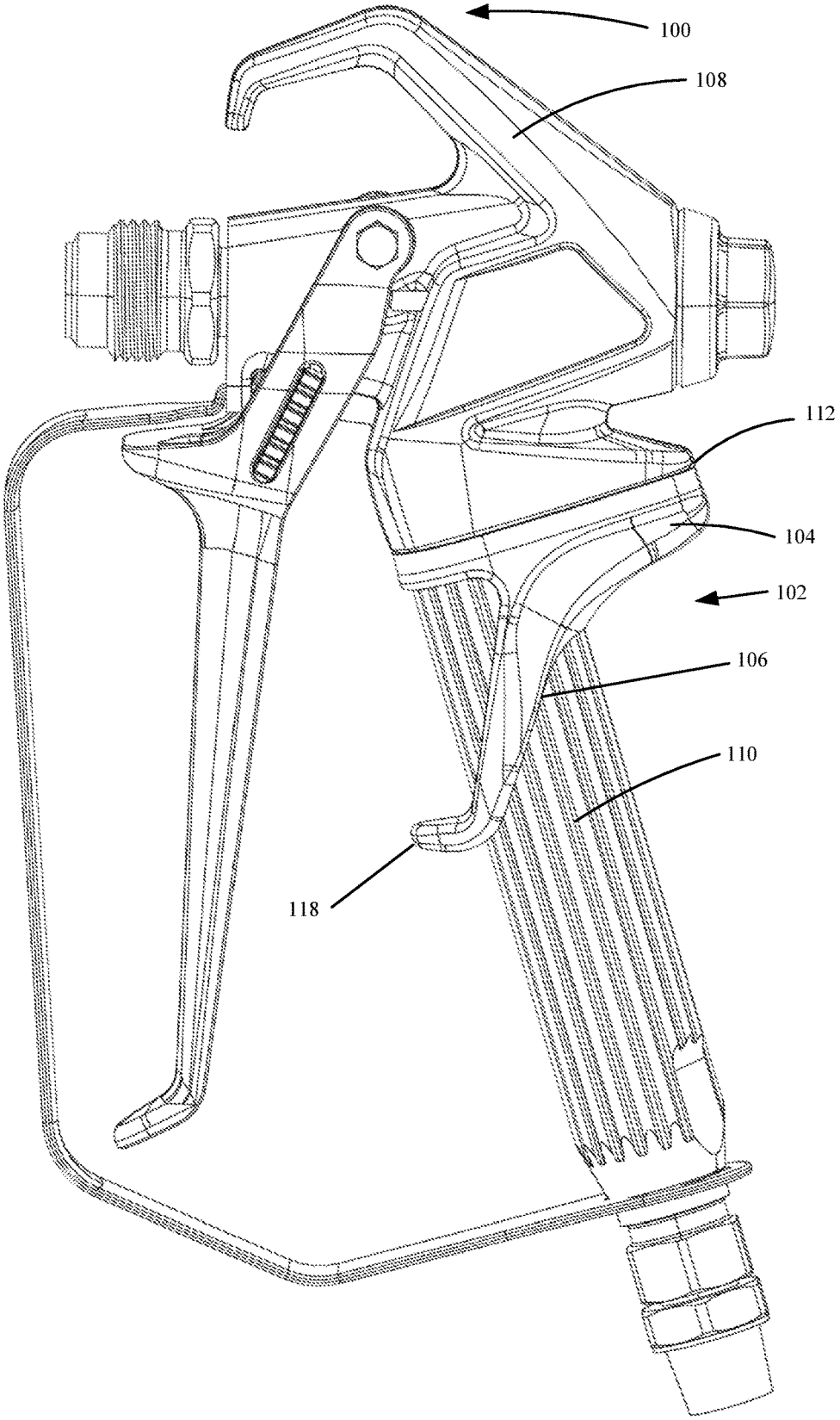
FIG. 1 illustrates a paint applicator in accordance with one embodiment of the present invention.

FIG. 1 illustrates a paint applicator in accordance with one embodiment of the present invention. Paint applicator 100 may comprise, in one embodiment, a finger rest 102, a head 108, and a handle 110. As illustrated in FIG. 1, finger rest 102 may comprise a base 104 and a grip 106. Base 104 may comprise a flange 114 and a hole 116 (both illustrated more clearly in FIG. 2). Flange 114 may, in one embodiment, be configured to secure base 104 at junction 112 of head 108 and handle 110. Flange 114 may, thus, be configured to maintain an alignment of base 104 and head 108 during use. In one embodiment, this allows a user to properly connect handle 110 to head 108 at a proper alignment. Hole 116 may be configured to receive a portion of handle 110.

In one embodiment, handle 110 fits into head 108 at junction 112 such that hole 116 borders handle 110. In one embodiment, handle 110 is actuated into position with head 108 such that a portion of handle 110 fits within head 108. In one embodiment, actuation comprises a clockwise or counterclockwise screwing motion, such that threads of handle 110 are received within grooves of head 108. However, in another embodiment, a portion of head 108 is received within handle 110, such that threads of head 108 are received within grooves of handle 110.

Other attachment mechanisms are also envisioned for assembling applicator 100, such as an external screw that pierces at least a portion of handle 110 and/or a portion of head 108, or a series of clips that attach head 108 to handle 110. In another embodiment, finger rest 102 comprises receiving mechanisms (such as threads/grooves) for both head 108 and handle 110, such that finger rest 102 interacts with a portion of both head 108 and handle 110, and serves to hold the two portions together to form paint applicator 100.

As shown in FIG. 1, grip 106 extends from base 104, away from head 108, and substantially surrounds handle 110. When base 104 of finger rest 102 is aligned at junction 112, grip 106 is, in one embodiment, directly under head 108. However, other positioning of grip 106 may also be envisioned, for example, based on user preference or an anticipated size of a user's hand. For example, in one embodiment, grip 106 is below, but not directly adjacent to, head 108. In one embodiment, because finger rest 102 is attached to head 108, and does not impede handle 110 from being actuated, base 104 maintains its alignment at junction 112. As a result, grip 106 will still be located directly under head 108. In one embodiment, grip 106 comprises a ledge 118 that protrudes out from handle 110. Ledge 118 may protrude substantially perpendicularly from handle 110, in one embodiment. In another embodiment, ledge 118 may protrude at an acute angle with respect to handle 110 and head 108, or an obtuse angle with respect to handle 110 and head 108. Ledge 118 may be configured, in one embodiment, to help a user properly hold paint applicator 100, avoiding or alleviating irritation and discomfort in the user's hand.

Figure 2:
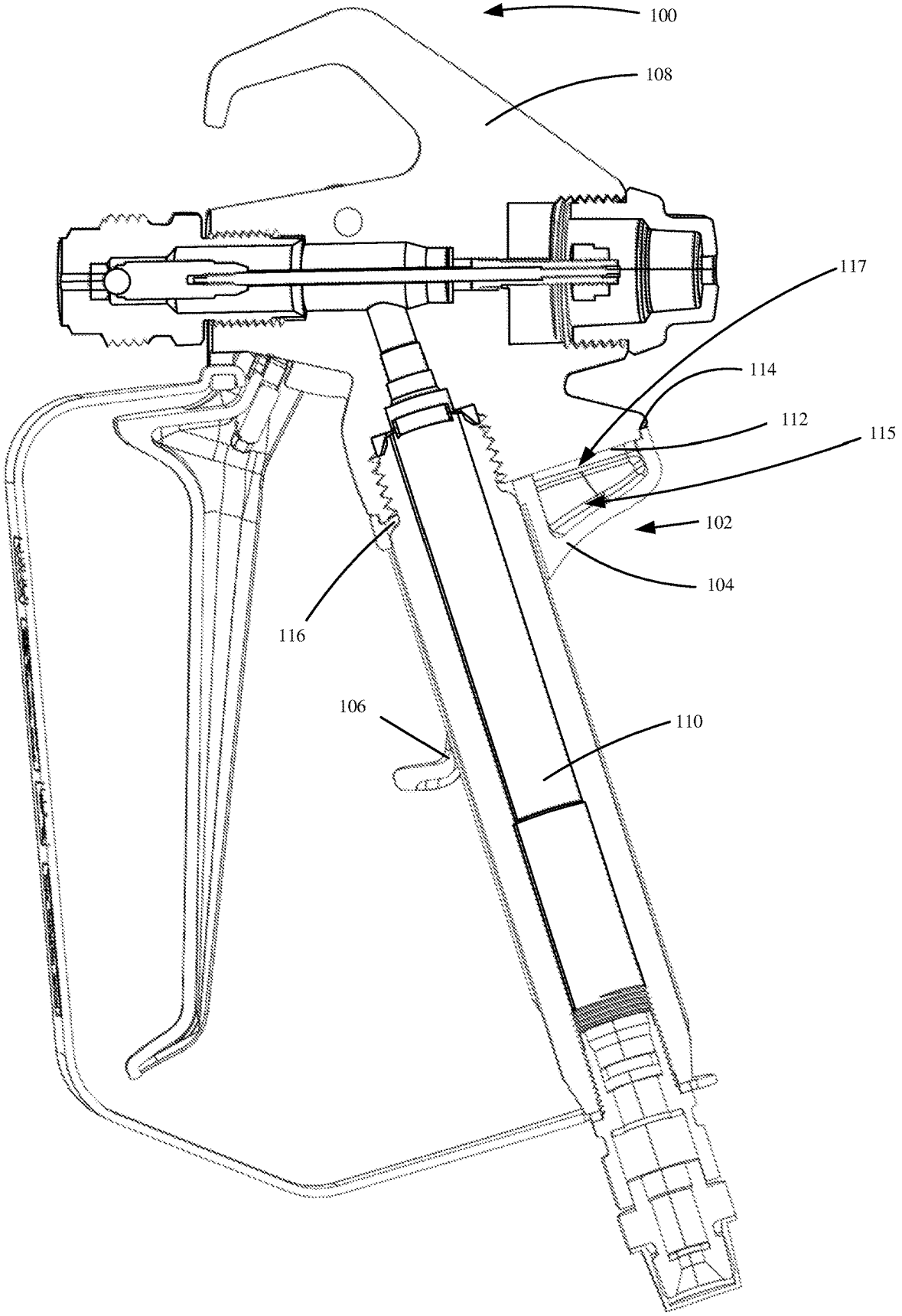
FIG. 2 illustrates a cross-sectional view of a paint applicator in accordance with one embodiment of the present invention.

FIG. 2 illustrates a cross-sectional view of a paint applicator in accordance with one embodiment of the present invention. As illustrated in FIG. 2, portion of a handle 110 may extend into head 108, past junction 112. A flange 114 may assist in holding head 108 and handle 110 together. As illustrated in FIG. 2, in one embodiment, handle 110 partially extends into head 108, and is secured in place, at least in part, by a series of threads on handle 110 received by groves on an internal surface of head 108. In another embodiment, however, the position of threads and grooves may be reversed, such that a portion of head 108 is received by, and extends into, a portion of handle 110. As shown, a recess 115 formed in base 104 of firmer rest 102 is configured to engage a projection 117 formed on head. 108 to prevent rotation of the support about the rotation axis.

Figure 3:
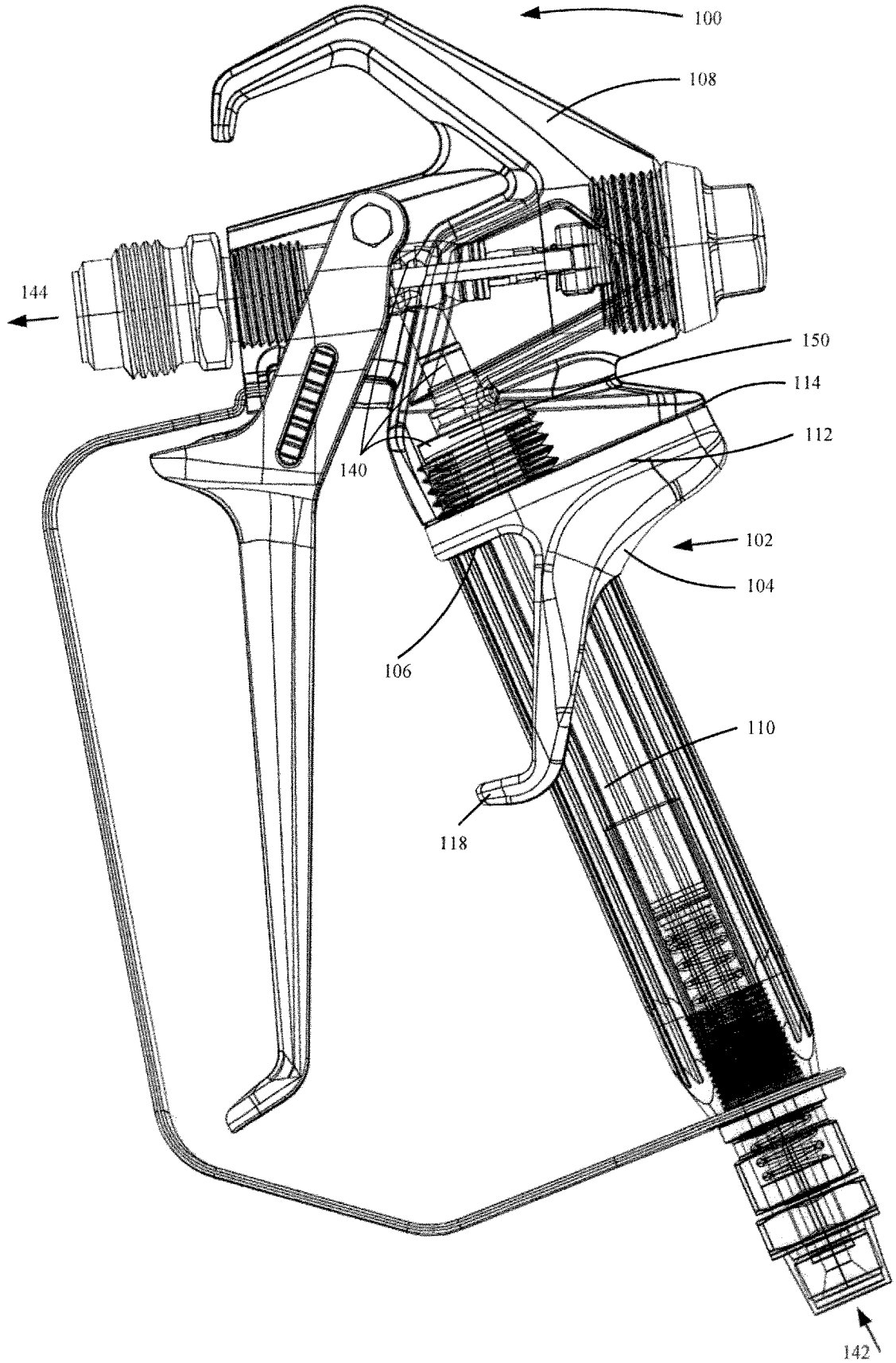
FIG. 3 illustrates a partial cutaway view of a paint applicator in accordance with one embodiment of the present invention.

FIG. 3 illustrates a partial cutaway view of a paint applicator in accordance with one embodiment of the present invention. As illustrated in FIG. 3, head 108 may comprise one or more internal components 140 configured to provide a flow path for a flow of paint through applicator 100, from an inlet 142, through handle 110, such that the paint exits through an outlet 144. Different internal components 140 may benefit from periodic cleaning or replacement, for example, in order to remove dried paint or other fluid that may interfere with a later paint operation. In one embodiment, paint applicator 100 comprises one or more filters 150 that may also require cleaning or replacement between paint applications. In one embodiment, finger rest 102 is designed to allow for easy access to internal components 140, and/or filters 150, in order to accommodate removal, cleaning and replacement as needed in between paint operations.

Figure 4:
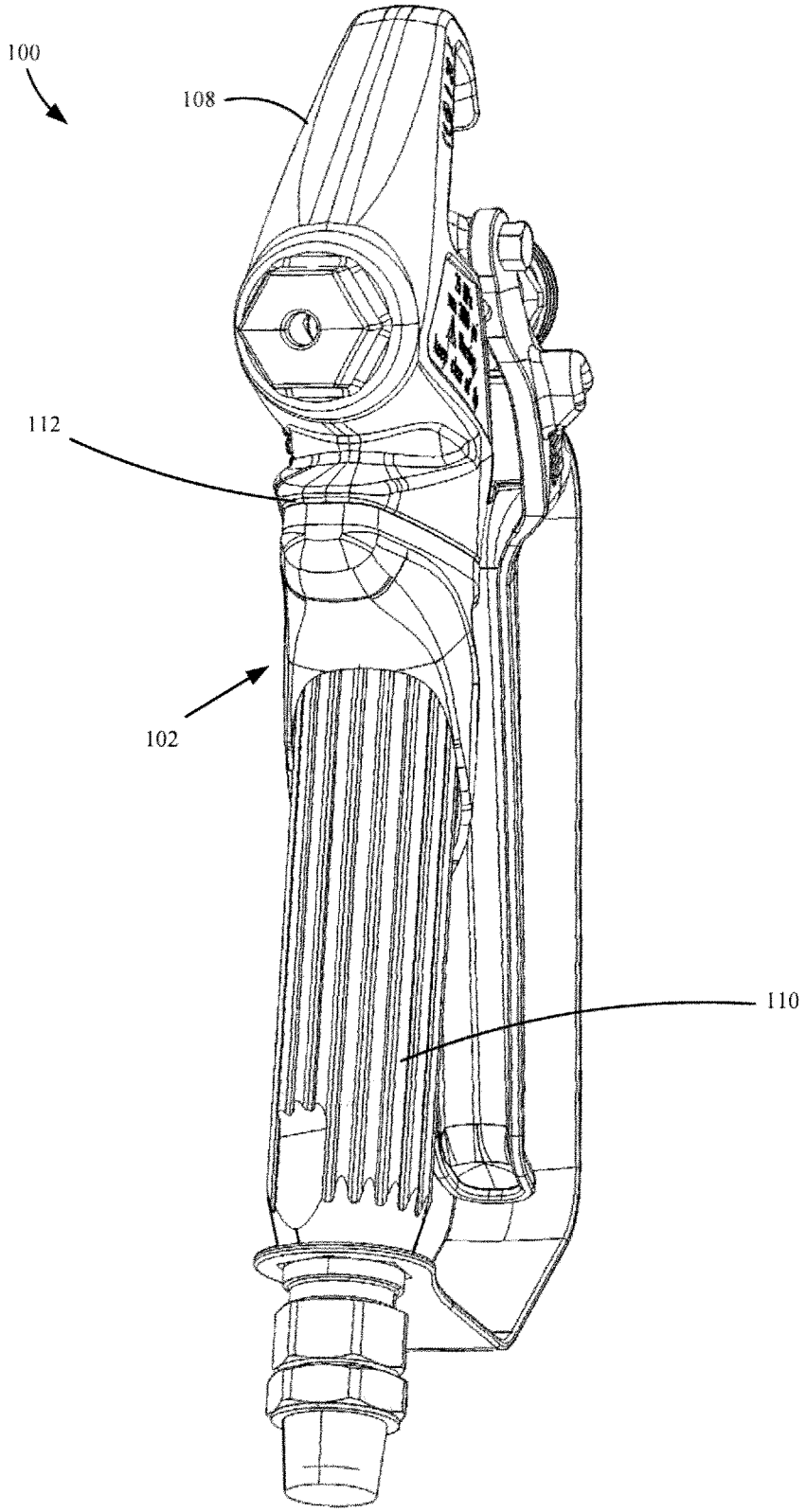
FIG. 4 illustrates a substantially rear view of a paint applicator in accordance with one embodiment of the present invention.

FIG. 4 illustrates a substantially rear view of a paint applicator in accordance with one embodiment of the present invention. As illustrated in FIG. 4, junction 112 is configured such that proper alignment of handle 110 and head 108 is visible to a user, such that, for example, contours of head 108 align with corresponding contours of finger rest 102. In one embodiment, finger rest 102 is prevented from moving, for example slightly clockwise or slightly counterclockwise along handle 110. In one embodiment, movement out of the alignment position is prevented by one or more grooves along handle 110 engaging corresponding grooves on an interior of finger rest 102. In another embodiment, movement out of the alignment position is prevented by internal contours of finger rest 102 engaging head 108.

Figure 5:
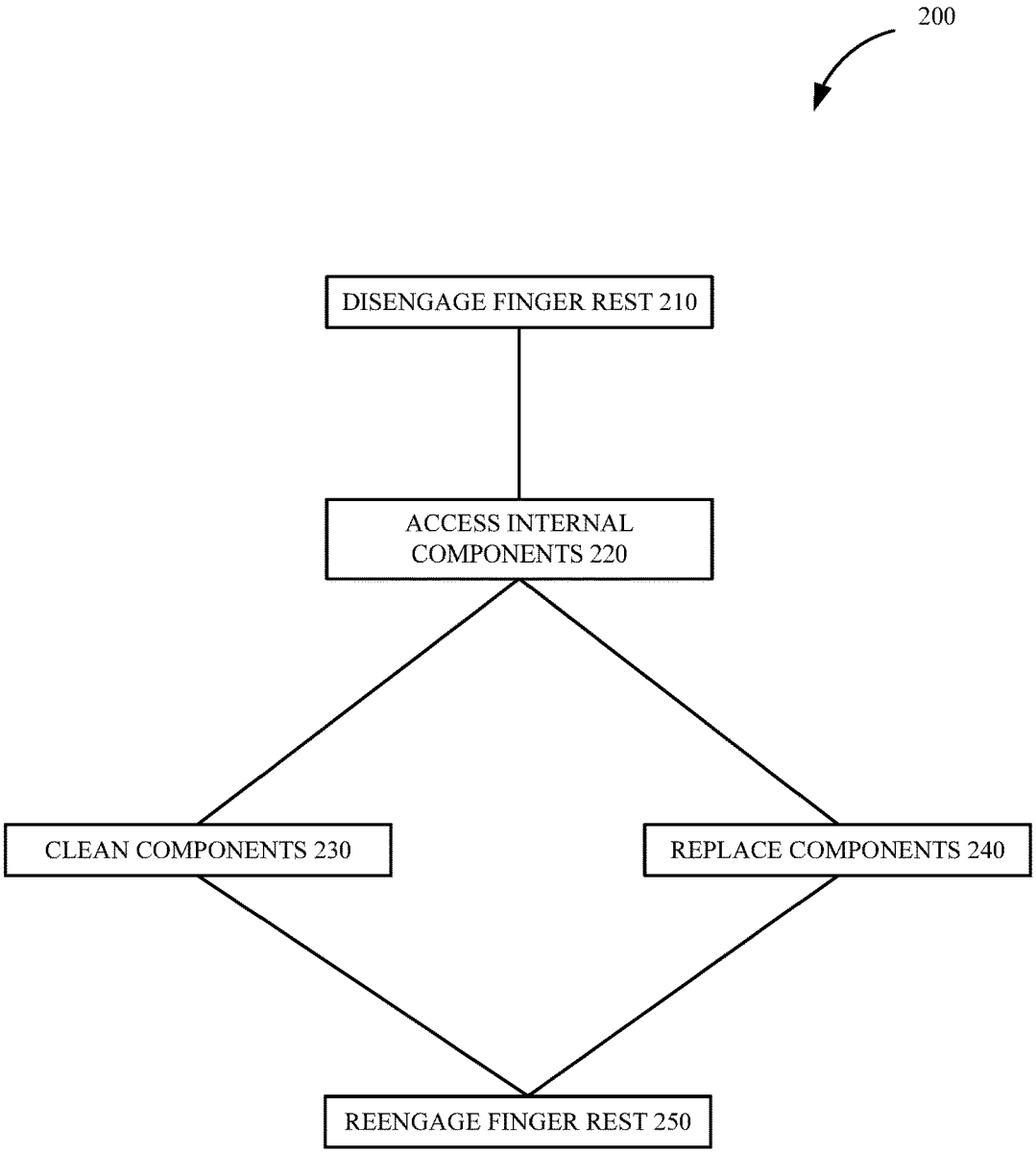
FIG. 5 illustrates one example method of cleaning a paint applicator in accordance with one embodiment of the present invention.

FIG. 5 illustrates an example method of cleaning a paint applicator in accordance with one embodiment of the present invention. In one embodiment, a paint applicator may need to be periodically cleaned, or one or more internal components 140, or filters 150, may need to be replaced periodically based on the occurrence of wear, malfunction or failure. For example, a filter 150 may be positioned within the flow path such that it receives paint flowing between an inlet and an outlet of a paint applicator. However, after a period of use, filter 150 may become clogged. In another embodiment, filter 150 may benefit from cleaning in order to remove dried paint before a new paint application, or cleaned after an initial paint application, while the paint is still in liquid form and more easily removed. Method 200 allows for a user to easily disconnect a handle of a paint applicator from a head of a paint applicator, remove and clean or replace internal components as needed, and reassemble the paint applicator such that it is ready for use at a later date, and properly realigned such that discomfort or irritation is reduced.

In block 210, a finger rest, grip or support is disengaged from a paint applicator. In one embodiment, disengaging comprises applying pressure to a portion of the finger rest, for example at the rear of a paint applicator, for example along junction 112 illustrated in FIG. 4. In one embodiment, sufficient applied pressure forces the finger rest to disengage from a head of the paint applicator. In another embodiment, the finger rest may be manufactured with, or such that it is substantially non-separable from, a handle of the paint applicator. In such an embodiment, disengaging the finger rest may comprise screwing or unscrewing the handle from the paint applicator. Additionally, disengaging the finger rest may comprise undoing a series of clips maintaining alignment of a finger rest along junction 112.

In block 220, internal components are accessible. In one embodiment, internal components may comprise components within a head or a handle of the paint applicator configured to interact with a paint flow path through the paint applicator. Accessing internal components may comprise, for example, removing intervening components, or may comprise removing the desired internal components from the paint applicator. For example, having access to a filter may comprise removing the filter from the paint applicator so that it is more easily cleaned.

In block 230, internal components and external components of the paint applicator may be available for cleaning or replacement. In one embodiment, cleaning comprises running a solution other than the applied fluid through the components. For example, water or another suitable solvent may be run through a filter, or through the interior of a paint applicator head in order to dissolve or remove leftover fluid. Cleaning internal components, as indicated in block 230, may also involve applying other fluids, for example, in order to ensure continued working order. For example, some components of a paint applicator may require application of oil in order to ensure that mechanical joints move as desired.

In block 240, removed internal components, or replacement parts may be reinserted within the paint applicator. For example, a filter may only be a single use filter, and may need to be replaced after a paint application. In another embodiment, if the paint applicator is no longer functioning properly, a broken part may be replaced with new counterpart.

In block 250, a finger rest is reengaged with the paint applicator. In one embodiment, this may comprise moving the finger rest and associated handle into place at a junction point, for example junction 112. In one embodiment, moving the handle into place comprises applying force in a screwing motion, for example, a user turning the handle clockwise or counterclockwise such that threads of either the handle or the head engage grooves of the opposing component. In one embodiment, the finger rest is also removable from a handle, for example in order to remove any excess paint or to more properly clean a handle 110 in between uses. In one embodiment, reengaging the finger rest, as indicated in block 250, also comprises refitting the finger rest over handle 110. In one embodiment, reengaging finger rest with the paint applicator comprises receiving, on a first end of the finger rest, a handle portion and, on a second end of the finger rest, the paint applicator.

Figure 6:
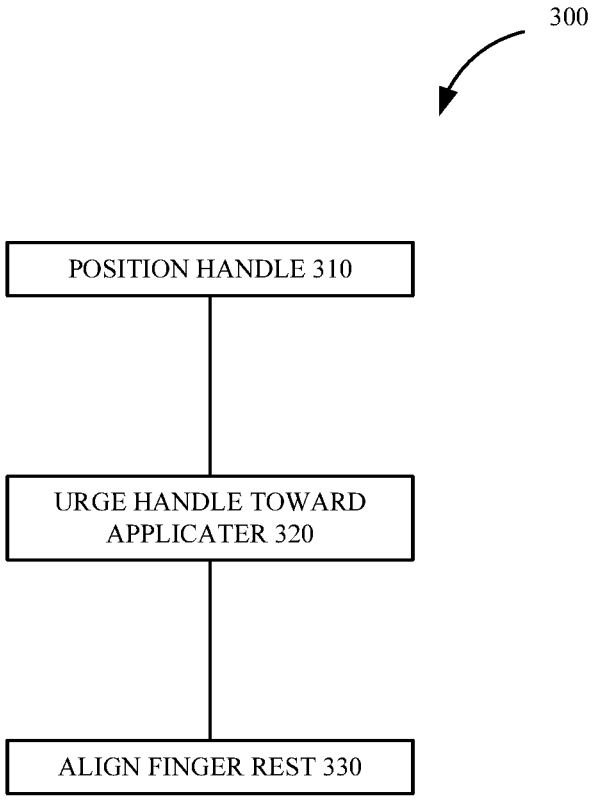
FIG. 6 illustrates one example method of replacing a handle of a paint applicator in accordance with one embodiment of the present application.

FIG. 6 illustrates an example method of replacing a handle of a paint applicator in accordance with one embodiment of the present application. Paint applicators may contain multiple parts that are removable and replaceable in between uses, for example to accommodate cleaning internal components of a paint applicator. One method of gaining access to the internal components within a paint applicator may comprise removing a paint applicator handle. Method 300 provides one example process for replacing a handle within a paint applicator such that the paint applicator can again be used by an operator for a paint application. Additionally, method 300 may be used for the first time to assemble a paint applicator, for example by a manufacturer or a user.

In block 310, the handle is initially positioned. In one embodiment, initially positioning comprises bringing the handle within contact range of the paint applicator. In one embodiment, bringing the handle within contact range comprises aligning a flange of the finger rest with a hole of a paint applicator head.

In block 320, a handle is urged toward an applicator. Urging a handle towards an applicator may comprise, in one embodiment, turning the handle either clockwise or counterclockwise such that a series of threads comprising a portion of the handle are aligned with, and engage a series of grooves along an internal portion of a paint applicator head. In another embodiment, urging the handle towards an applicator comprises the handle receiving, within a series of grooves, a series of threads protruding from a head of the paint applicator. In another embodiment, urging the handle towards the applicator comprises applying a series of clips that force the applicator and handle into contact with each other.

In block 330, the finger rest is aligned in a use position. In one embodiment, the use position comprises an alignment position configured to reduce irritation and discomfort experienced by a user of the paint applicator. In one embodiment, aligning the finger rest, as indicated in block 330, comprises moving the finger rest into place such that grooves of the finger rest align with corresponding grooves and contours of the paint applicator head. In another embodiment, aligning the finger rest comprises aligning manufacturer-indicated points on the finger rest and the paint applicator head. For example, in one embodiment, a manufacturer may paint, print, or otherwise indicate a position on the paint applicator head and a position on the finger rest that should align with each other when the finger rest is in proper alignment. In another embodiment, a manufacturer may make indentations or grooves on the paint applicator head and corresponding marks or indentations on the finger rest such that the grooves align when the finger rest is in proper alignment.

Figure 7A:
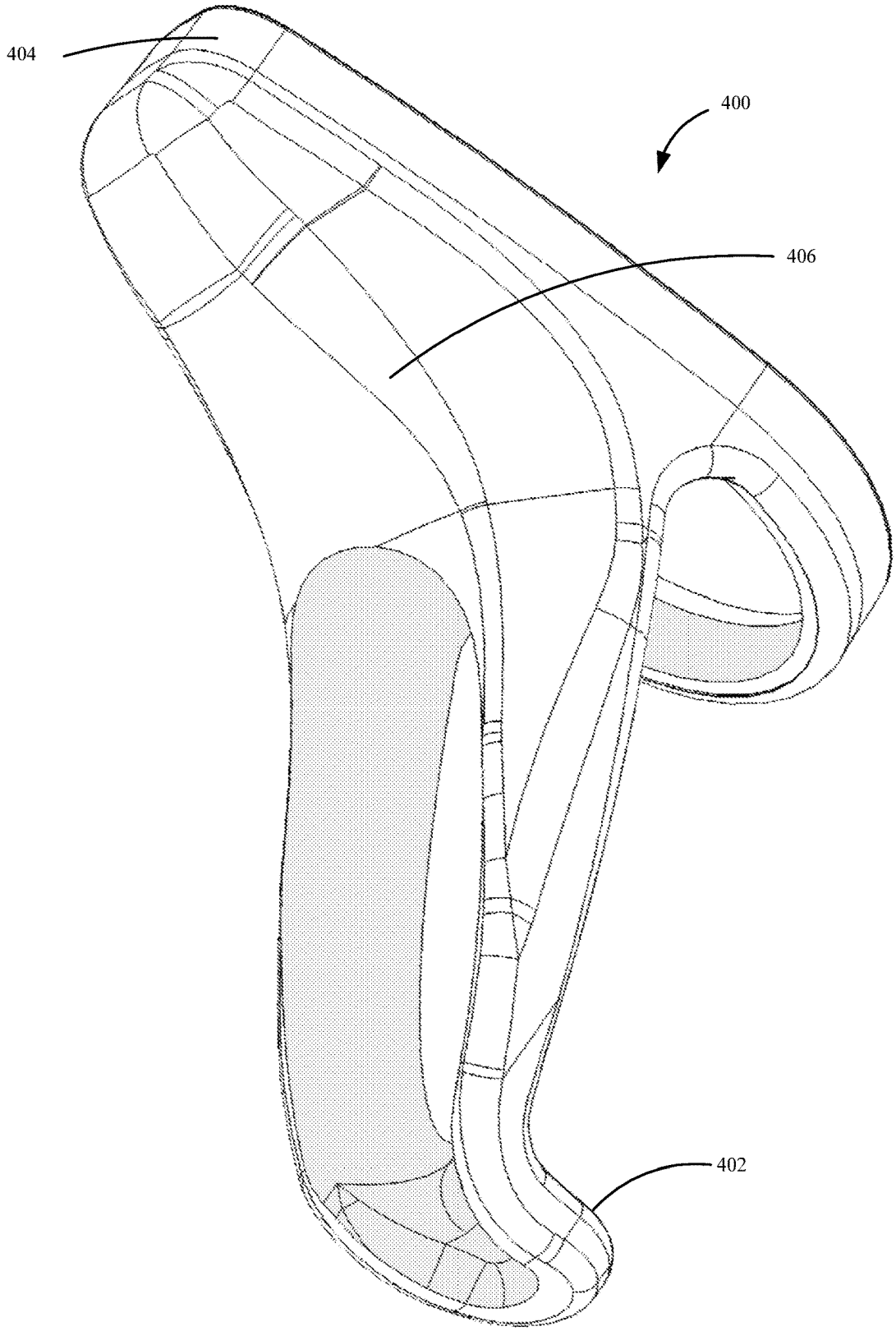
FIGS. 7A and B illustrates view of an example finger rest for a paint applicator in accordance with one embodiment of the present invention.
Figure 7B:
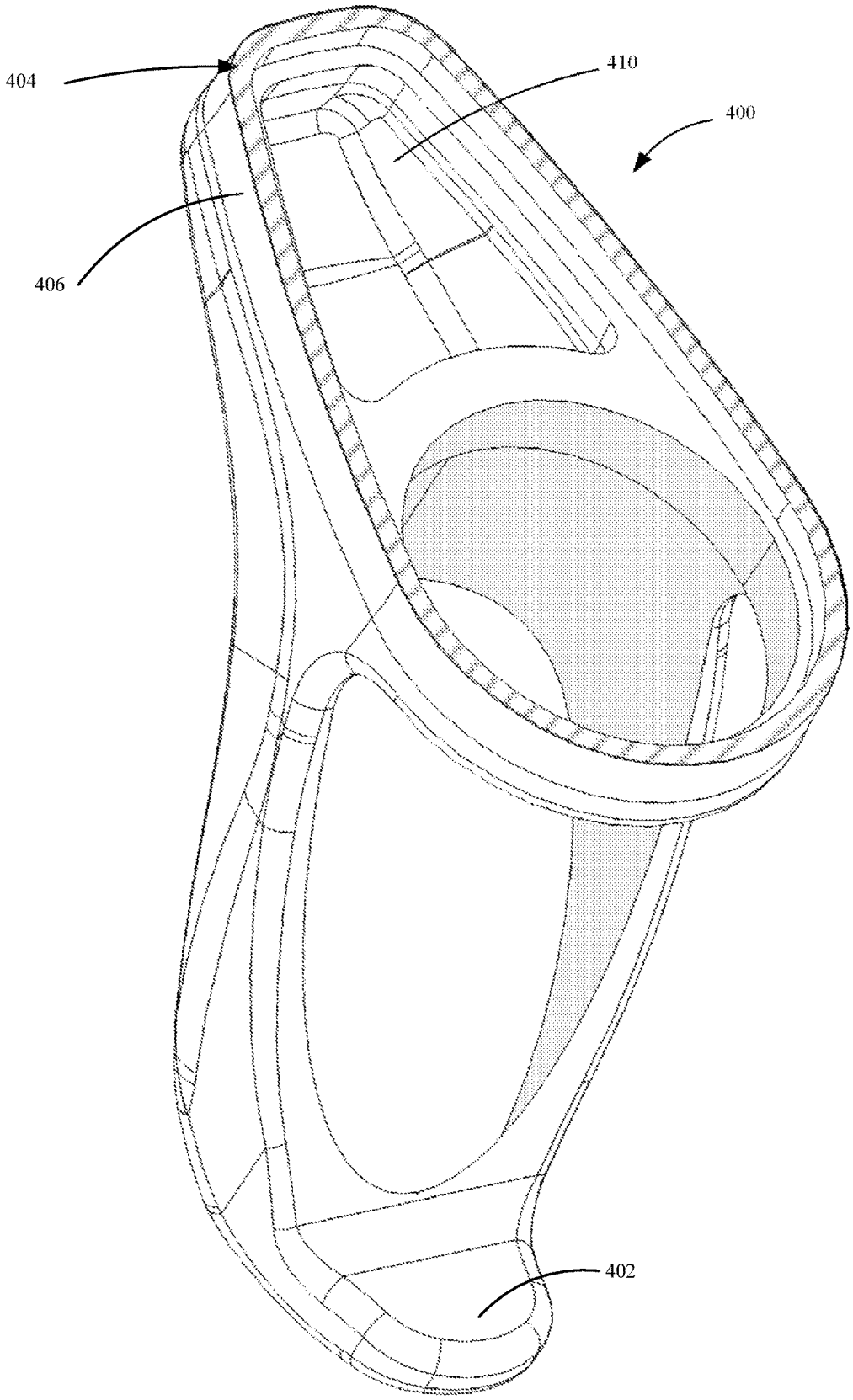

FIGS. 7A and 7B illustrate views of an example finger rest for a paint applicator in accordance with one embodiment of the present invention. FIG. 7A illustrates a rearward-side view of a finger rest 400. FIG. 7B illustrates a frontal-side view of a finger rest 400. In one embodiment, finger rest 400 comprises a base 406 and a ledge 402. Finger rest 400 is configured, in one embodiment, to attach to a paint applicator along junction 404. In one embodiment, finger rest 400 does not include ledge 402, and is configured to fit on a handle of a paint applicator, for example handle 110 of paint applicator 100. As illustrated in FIG. 7B, finger rest 400 may comprise internal features 410 (illustratively a recess) configured to maintain proper alignment of the finger rest 400, for example by engaging corresponding features (e.g., projection)(not shown in FIGS. 7A and 7B) of a paint applicator head.

In one embodiment, base 406 comprises a flange and a hole (not shown). The flange and hole, in one embodiment, may be similar to flange 114 and hole 116 described above. The flange may be configured to position base 406 along junction 404 such an alignment position is maintained between finger rest 400 and a paint applicator head, for example head 108 described above. The hole may be configured to receive a handle of the paint applicator, in one embodiment. The handle, in one embodiment, is configured to be screwed into the head at junction 404, such that the hole borders the handle. In one embodiment, finger rest 400 extends from the base 406, away from a paint applicator head, and substantially surrounds a handle of a paint applicator. In one embodiment, because base 406 is attached and aligned with a head at junction 404, finger rest 400 is positioned such that the paint applicator is pointing in the desired direction when a user holds the paint applicator by the handle. Furthermore, when a handle is removed from, and then reattached to, a paint applicator, finger rest 400, in one embodiment, returns to the desired position, such that when the user holds the paint applicator by the handle again, the paint applicator will still be pointing in the desired direction.

In one embodiment, finger rest 400 is formed from a single piece of material with no seams. In another embodiment, finger rest comprises two or more portions connected at one or more seams. Finger rest 400 may comprise, in one embodiment, a polymer-based material such as synthetic or natural rubber, or plastic. In another embodiment, the finger rest may comprise metal.

Although the present invention has been described with reference to preferred embodiments, workers skilled in the art will recognize that changes may be made in form and detail without departing from the spirit and scope of the invention.

What is claimed is:

1. A liquid applicator comprising:

a head assembly with an outlet;

a handle rotatably couplable to the head assembly by rotating the handle about a rotation axis, the handle having an inlet configured to receive a fluid from a fluid source, wherein a fluid path extends through the liquid applicator from the inlet to the outlet;

a trigger coupled to the head assembly that, when actuated, allows a fluid flow from the inlet to the outlet; and a support configured to receive a portion of the handle, the support comprising a ledge portion; and an alignment feature comprising:

a projection on one of the head assembly or the support, and a recess formed on the other one of the head assembly or the support, wherein, during coupling of the handle to the head assembly, the handle is configured to rotate independent of the support and the recess is configured to engage the projection to prevent rotation of the support about the rotation axis to maintain the support in a fixed alignment position relative to the head assembly in which the ledge portion:

is located between the handle and the trigger, and extends toward the trigger.

2. The liquid applicator of claim 1, wherein the fluid comprises paint, and the handle and head assembly are configured to couple through a threaded connection.

3. The liquid applicator of claim 1, wherein the recess is configured to receive the projection.

4. The liquid applicator of claim 1, wherein, when in the fixed alignment position, a first surface of the support is flush with a second surface of the head assembly.

5. The liquid applicator of claim 1, wherein, when in the fixed alignment position, an indicia on the support visually aligns with a corresponding indicia on the head assembly.

6. The liquid applicator of claim 1, wherein the support comprises a rounded concave portion on a side of the support that is opposite from the ledge portion.

7. The liquid applicator of claim 1, wherein, when the handle is coupled to the head assembly, the handle is disposed within a hole formed in the support.

8. A liquid applicator comprising:

a head assembly having an outlet;

a support comprising a support body that defines a hole; and a handle rotatably couplable to the head assembly by rotating the handle, about a rotation axis, independent of the support, wherein when the handle is coupled to the head assembly, the handle extends at least partially into the hole of the support, the handle having an inlet configured to receive a fluid from a fluid source, wherein a fluid path extends through the liquid applicator from the inlet to the outlet; and an alignment feature comprising:

a projection on one of the head assembly or the support, and a recess formed on the other one of the head assembly or the support, wherein the recess is configured to engage the projection to prevent rotation of the support about the rotation axis.

9. The liquid applicator of claim 8, wherein the receiving hole is defined, at least in part, by a concave surface.

10. The liquid applicator of claim 8, further comprising:

a trigger coupled to the head assembly that, when actuated, allows a fluid flow from the inlet to the outlet.

11. The liquid applicator of claim 10, wherein the projection and recess are configured to maintain the support in a fixed alignment position relative to the head assembly in which a portion of the support is disposed between the trigger and the handle.

12. The liquid applicator of claim 11, wherein the hole defines an aperture that the handle extends through when coupled to the head assembly.

13. The liquid applicator of claim 11, wherein the support body defines a rounded concave surface disposed on a side of the support opposite from the trigger.

14. The liquid applicator of claim 8, wherein the recess is configured to receive the projection.

15. The liquid applicator of claim 10, wherein the portion of the support comprises a ledge that, extends toward the trigger.

* * * * *